US006623408B1

(12) United States Patent
Kyle

(10) Patent No.: US 6,623,408 B1
(45) Date of Patent: Sep. 23, 2003

(54) SPEED BAG SUPPORT APPARATUS

(76) Inventor: Rory I. Kyle, 248 SW. Parkway #1520, Lewisville, TX (US) 75067

( * ) Notice: Subject to any disclaimer, the term of this patent is extended or adjusted under 35 U.S.C. 154(b) by 0 days.

(21) Appl. No.: 10/185,621

(22) Filed: Jun. 28, 2002

(51) Int. Cl.[7] ..... A63B 69/20
(52) U.S. Cl. ..... 482/86
(58) Field of Search ..... 473/479–485, 473/441, 442, 443; 482/83, 86, 87, 90, 908, 85, 84, 88, 89; 21/191

(56) References Cited

U.S. PATENT DOCUMENTS

| | | | | |
|---|---|---|---|---|
| 647,487 | A | * | 4/1900 | Frazier |
| 992,868 | A | * | 5/1911 | Gorman |
| 2,659,603 | A | * | 11/1953 | Glasser |
| 3,411,497 | A | * | 11/1968 | Rickey et al. |
| 4,093,212 | A | | 6/1978 | Jacques |
| D325,233 | S | | 4/1992 | Brunette |
| 5,674,157 | A | | 10/1997 | Wilkinson |
| 5,733,193 | A | | 3/1998 | Allard et al. |
| 5,788,613 | A | | 8/1998 | Grimaldi |
| 5,944,639 | A | | 8/1999 | Ray |

OTHER PUBLICATIONS

Cataloge of Gymnastic Apparatus, Narragansett Machine Providence, R.I. USA Copyright 1925.*

* cited by examiner

*Primary Examiner*—Jerome W. Donnelly

(57) ABSTRACT

A speed bag support apparatus for providing a retractable platform for a speed bag. The speed bag support apparatus includes a wall mounting assembly comprising a plurality of stanchion members. Each of the stanchion members is designed for being coupled to a vertical support surface for supporting the wall mounting assembly from the vertical support surface. A platform assembly is rotatably coupled to the wall mounting assembly. The platform assembly is rotatable between a deployed position defined by the platform assembly being positioned substantially perpendicular to the wall mounting assembly and a stored position defined by the platform assembly being positioned substantially parallel to the wall mounting assembly. The platform assembly is designed for receiving the speed bag whereby the platform assembly suspends the speed bag over a floor to be used by a user when the support assembly is in the deployed position.

10 Claims, 4 Drawing Sheets

SPEED BAG SUPPORT APPARATUS

BACKGROUND OF THE INVENTION

1. Field of the Invention

The present invention relates to boxing fitness devices and more particularly pertains to a new speed bag support apparatus for providing a retractable platform for a speed bag.

2. Description of the Prior Art

The use of boxing fitness devices is known in the prior art. U.S. Pat. No. 5,733,193 describes a system for providing entertainment by allowing a user to hit a speed bag. Another type of boxing fitness device is U.S. Pat. No. 5,674,157 having a device for exercise using rebounding and boxing techniques. U.S. Pat. No. 4,093,212 has a punching bag mounted to a vertical surface for practicing upper cuts. U.S. Pat. No. 5,944,639 has a device for adjusting a height of a speed bag from a floor for practicing defense arts. U.S. Pat. No. 5,788,613 has an apparatus providing for portable and adjustable use of a speed bag. U.S. Pat. No. Des. 325,233 shows a punching and kicking bag for boxing and the martial arts.

While these devices fulfill their respective, particular objectives and requirements, the need remains for a device that has certain improved features that allow the speed bag to be stored in a position to allow use of the area where the speed bag was positioned.

SUMMARY OF THE INVENTION

The present invention meets the needs presented above by providing a platform assembly that is pivotally coupled to a wall mounting assembly to allow the platform assembly to be pivoted against the wall mounting assembly so that the space where the platform assembly was located can be utilized.

Still yet another object of the present invention is to provide a new speed bag support apparatus that provides a stable support for using a speed bag when the platform in a deployed position.

To this end, the present invention generally comprises a wall mounting assembly comprising a plurality of stanchion members. Each of the stanchion members is designed for being coupled to a vertical support surface for supporting the wall mounting assembly from the vertical support surface. A platform assembly is rotatably coupled to the wall mounting assembly. The platform assembly is rotatable between a deployed position defined by the platform assembly being positioned substantially perpendicular to the wall mounting assembly and a stored position defined by the platform assembly being positioned substantially parallel to the wall mounting assembly. The platform assembly is designed for receiving the speed bag whereby the platform assembly suspends the speed bag over a floor to be used by a user when the support assembly is in the deployed position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
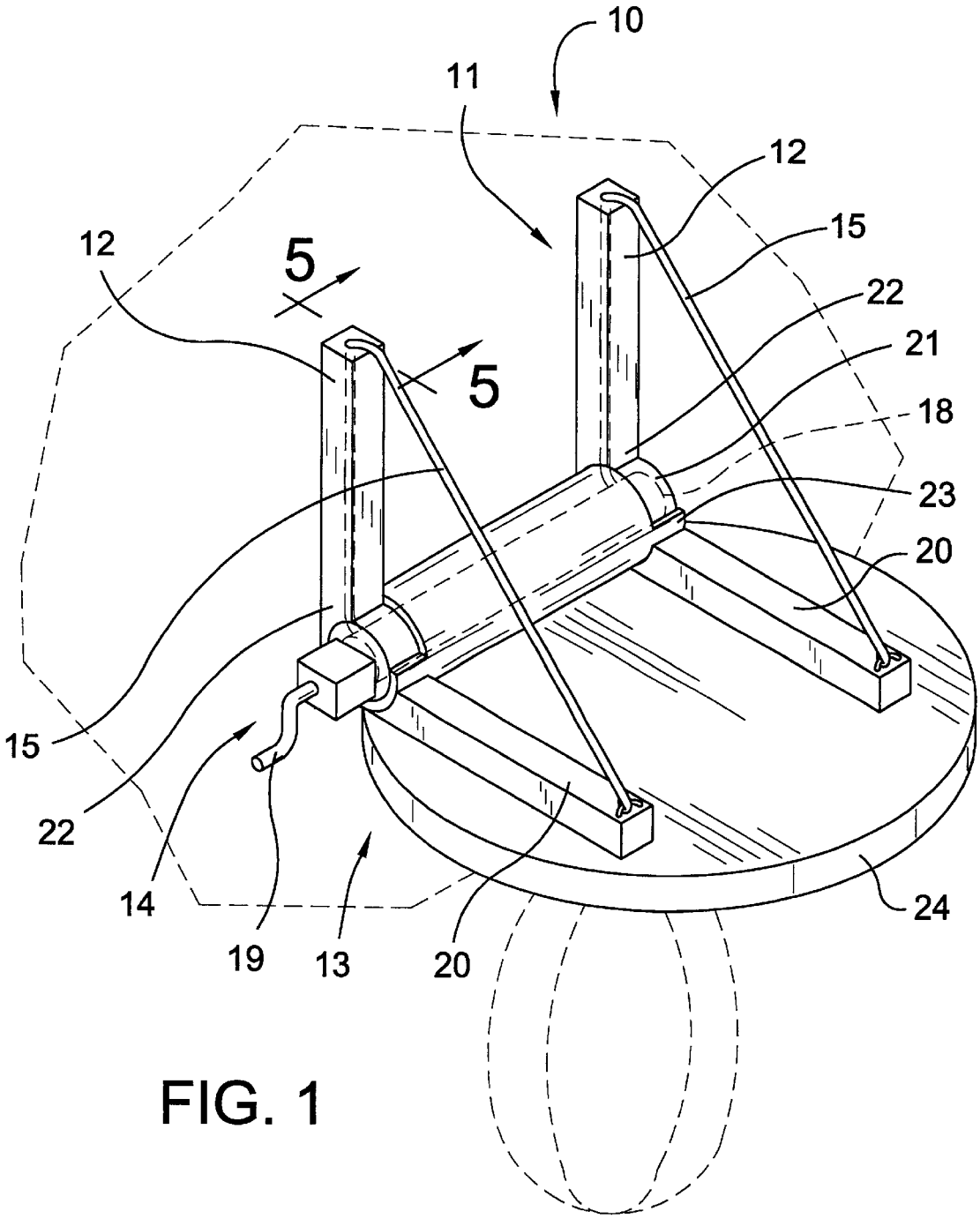
FIG. 1 is a perspective view of a new speed bag support apparatus according to the present invention.
Figure 2:
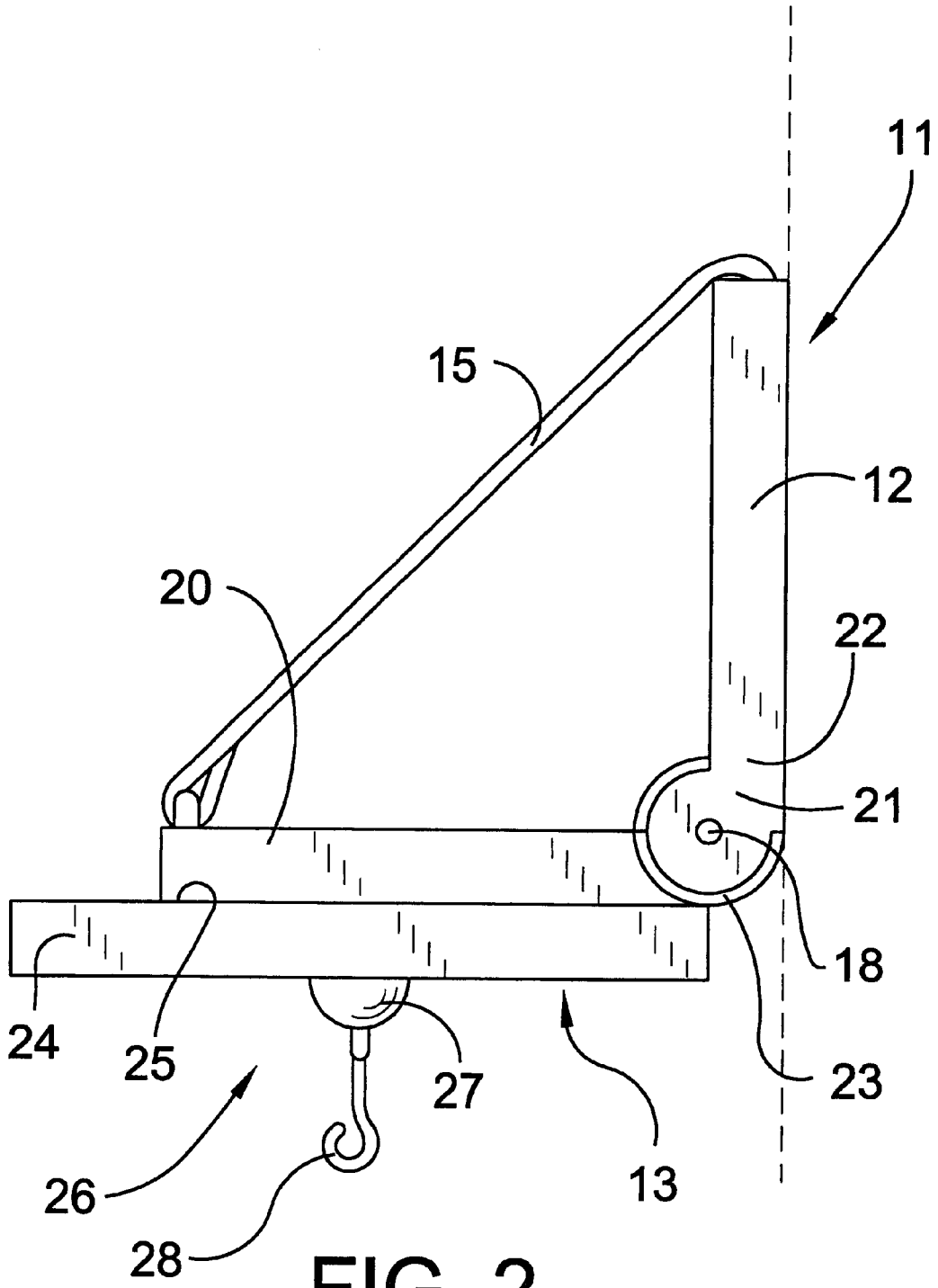
FIG. 2 is a side view of the present invention with the platform assembly in the deployed position.
Figure 3:
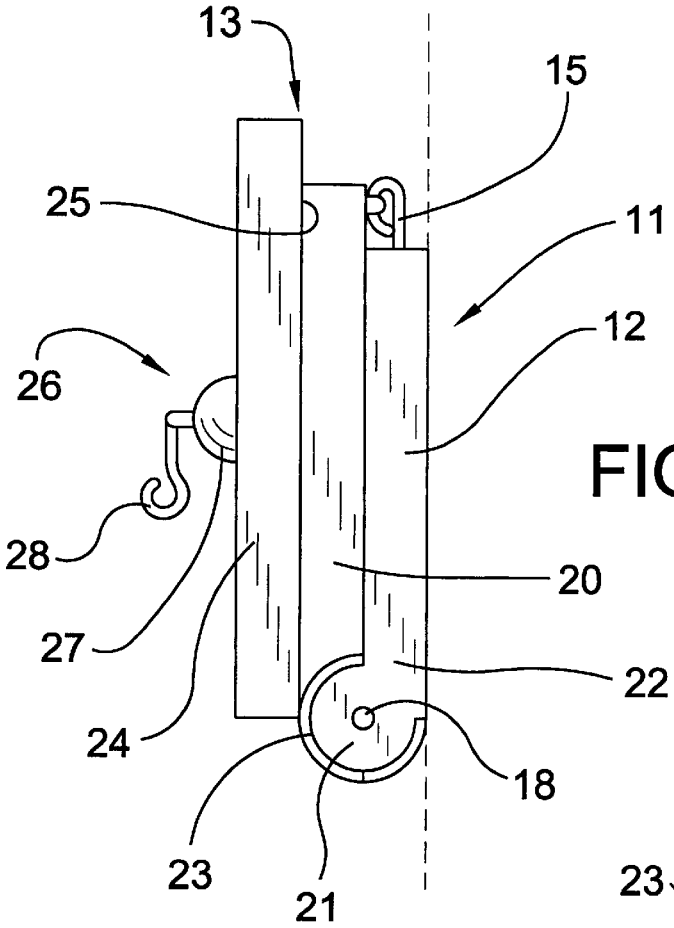
FIG. 3 is a side view of the present invention with the platform assembly in the stored position.
Figure 4:
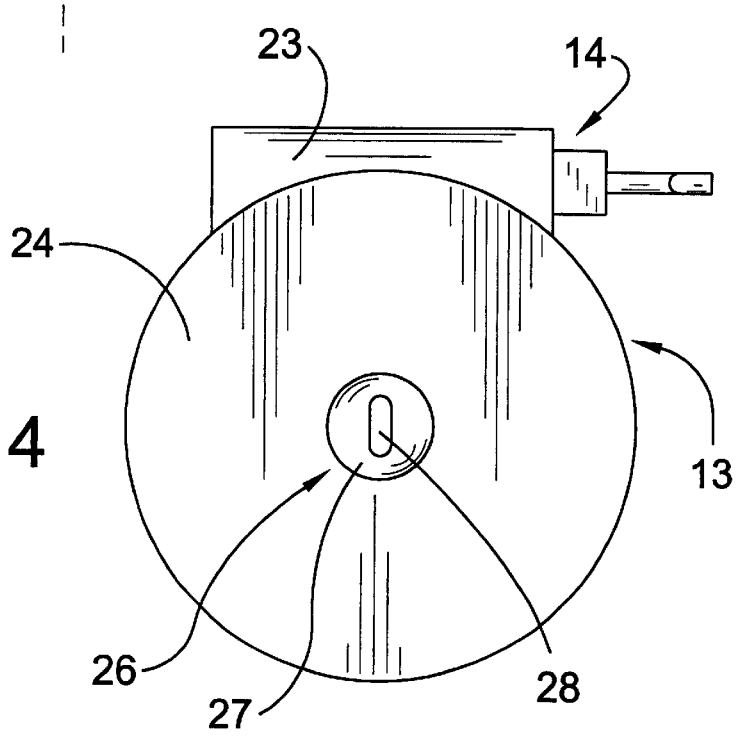
FIG. 4 is a bottom view of the present invention.
Figure 5:
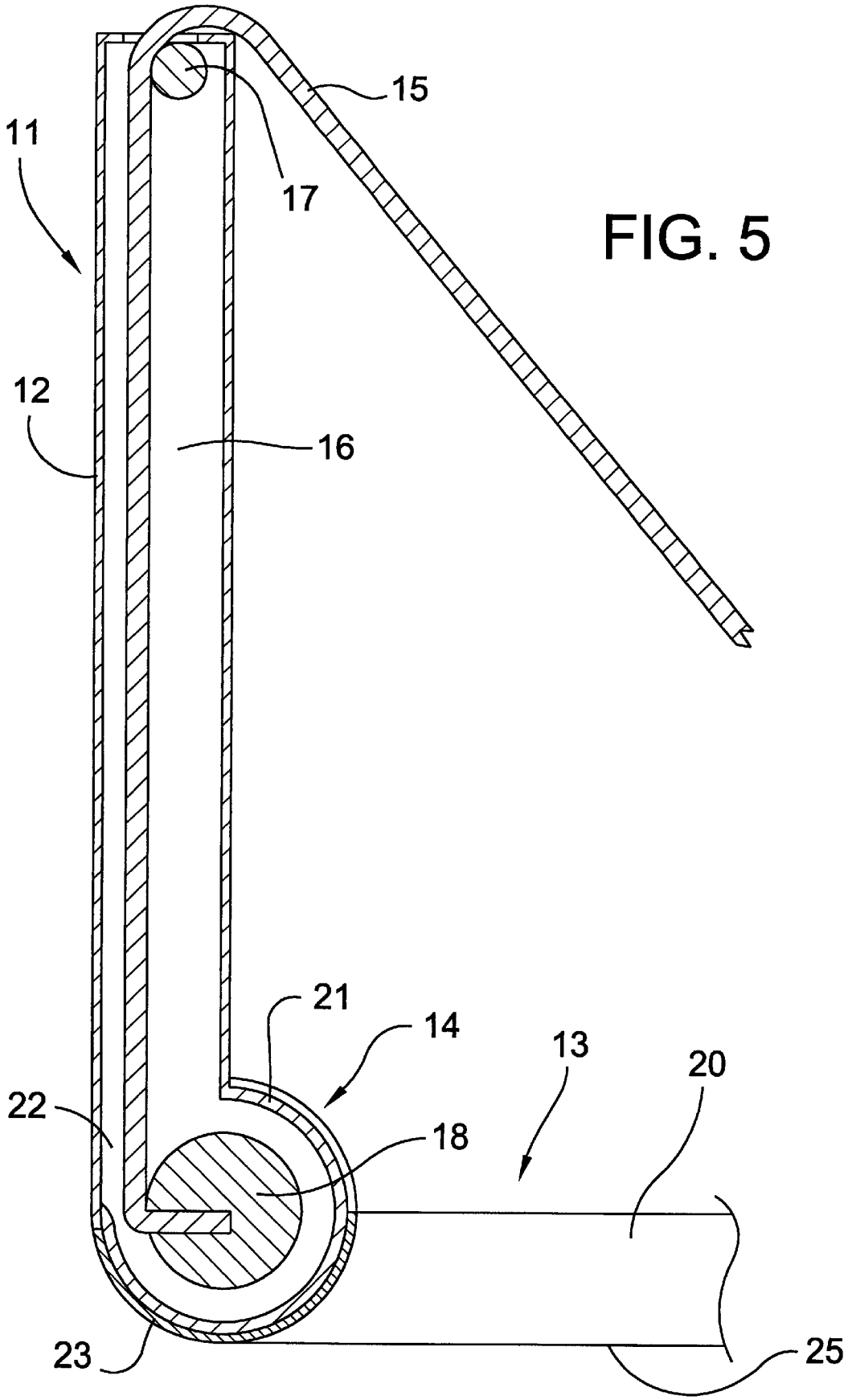
FIG. 5 is a cross-sectional view of the present invention taken along line 5—5 of FIG. 1.

With reference now to the drawings, and in particular to FIGS. 1 through 5 thereof, a new speed bag support apparatus embodying the principles and concepts of the present invention and generally designated by the reference numeral 10 will be described.

As best illustrated in FIGS. 1 through 5, the speed bag support apparatus 10 generally comprises a wall mounting assembly 11 comprising a plurality of stanchion members 12. Each of the stanchion members 12 is designed for being coupled to a vertical support surface for supporting the wall mounting assembly 11 from the vertical support surface.

A platform assembly 13 is rotatably coupled to the wall mounting assembly 11. The platform assembly 13 is rotatable between a deployed position defined by the platform assembly 13 being positioned substantially perpendicular to the wall mounting assembly 11 and a stored position defined by the platform assembly 13 being positioned substantially parallel to the wall mounting assembly 11. The platform assembly 13 is designed for receiving the speed bag whereby the platform assembly 13 suspends the speed bag over a floor to be used by a user when the support assembly is in the deployed position.

An actuating assembly 14 is coupled to each of the stanchion members 12 of the wall mounting assembly 11. The actuating assembly 14 is operationally coupled to the platform assembly 13 whereby the actuating system rotates the platform assembly 13 between the deployed position and the stored position when the actuating assembly 14 is actuated by the user.

The actuating assembly 14 comprises a plurality of cable members 15. The cable members 15 are coupled to the platform assembly 13. Each of the cable members 15 extend through an interior space 16 of an associated one of the stanchion members 12 whereby the cable members 15 pull the platform assembly 13 into the stored position when the cable members 15 are drawn into the interior space 16 of the associated one of the stanchion members 12 by the user.

The actuating assembly 14 comprises a plurality of pulley members 17. Each of the pulley members 17 is rotatably coupled to the associated one of the stanchion members 12 whereby the pulley members 17 are positioned in the interior space 16 of the associated one of the stanchion members 12. Each of the pulley members 17 engages one of the cable members 15 whereby each of the pulley members 17 rotates when the associated one of the cable members 15 is drawn across the associated one of the pulley members 17 to reduce contact between the associated one of the stanchion members 12 and the associated one of the cable members 15.

The actuating assembly 14 comprises a winding axle 18. The winding axle 18 is rotatably coupled to the stanchion members 12 of the wall mounting assembly 11. The winding axle 18 is coupled to each of the cable members 15 opposite the platform assembly 13. The cable members 15 are wound onto the winding axle 18 for rotating the platform assembly 13 into the stored position when the winding axle 18 is actuated by the user. The cable members 15 are unwound from the winding axle 18 for rotating the platform assembly 13 to the deployed position from the stored position when the winding axle 18 is actuated by the user.

The actuating assembly 14 comprises a crank member 19. The crank member 19 is operationally coupled to the winding axle 18. The crank member 19 extends from the wall mounting assembly 11 whereby the crank member 19 is designed for being rotated by a hand of the user for rotating the winding axle 18 when the user wishes to rotate the platform assembly 13 between the stored position and the deployed position.

The platform assembly 13 comprises a plurality of support members 20. Each of the support members 20 is rotatably coupled to the wall mounting assembly 11. The support members 20 are designed for supporting the speed bag from the wall mounting assembly 11 above the floor.

The wall mount assembly comprises an axle member 21. The axle member 21 is coupled to a bottom end 22 of each of the stanchion members 12.

The platform assembly 13 comprises a sleeve member 23. The sleeve member 23 is coupled to the support members 20. The sleeve member 23 is slidably positioned over the axle member 21 of the wall mount assembly whereby the sleeve member 23 is capable of rotating around the axle member 21 for permitting rotation of the platform assembly 13 with respect to the wall mount assembly.

The platform assembly 13 comprises a platform member 24. The platform member 24 is coupled to a bottom surface 25 of each of the support members 20 whereby the platform member 24 is positioned opposite the wall mount assembly when the platform assembly 13 is positioned in the stored position. The platform member 24 is designed for being coupled to the speed bag whereby the platform member 24 is for rebounding the speed bag when the speed bag is struck by the user.

The platform assembly 13 comprises a mounting assembly 26. The mounting assembly 26 is coupled to the platform assembly 13 opposite the support members 20. The mounting assembly 26 is designed for being coupled to the speed bag whereby the mounting assembly 26 is for permitting the speed bag to pivot with respect to the platform member 24 when the speed bag is struck by the user.

The mounting assembly 26 of the platform assembly 13 comprises a base portion 27 and a hook portion 28. The base portion 27 is coupled to the platform member 24. The hook portion 28 is pivotally coupled to the base portion 27. The hook portion 28 is designed for being coupled to the speed bag whereby the hook portion 28 of pivots with respect to the base portion 27 when the speed bag is struck by a the user.

In use, the user mounts each of the stanchion members 12 to a wall. The user then cranks the crank member 19 to rotate the winding axle 18 and to either wind the cable members 15 onto the winding axle 18 or to unwind the cable members 15 from the winding axle 18. When the cable members 15 are wound onto the winding member the platform assembly 13 is raised in the stored position to provide additional space that would be wasted when the platform assembly 13 is in the deployed position and the speed bag is not being used. When the cable members 15 are unwound from the winding axle 18 the platform assembly 13 is lowered to the deployed position to allow the user to use the speed bag.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A speed bag support apparatus for supporting and storing a speed bag, the speed bag support apparatus comprising:

a wall mounting assembly comprising at least one stanchion member, said stanchion member being adapted for being coupled to a vertical support surface for supporting said wall mounting assembly from the vertical support surface;

a platform assembly being rotatably coupled to said wall mounting assembly, said platform assembly being rotatable between a deployed position defined by said platform assembly being positioned substantially perpendicular to said wall mounting assembly and a stored position defined by said platform assembly being positioned substantially parallel to said wall mounting assembly, said platform assembly being adapted or receiving the speed bag such that platform assembly suspends the speed bag over a floor to be used by a user when said support assembly is in the deployed position;

an actuating assembly being coupled to said stanchion member of said wall mounting assembly, said actuating assembly being operationally coupled to said platform assembly such that said actuating system rotates said platform assembly between the deployed position and the stored position when said actuating assembly is actuated by the user;

said actuating assembly comprising at least one cable member, said cable member being coupled to said platform assembly, said cable member extending through an interior space of said stanchion member such that said cable member pulls said platform assembly into the stored position when said cable member is drawn into said interior space of said stanchion member by the user and a mounting, coupled to said platform assembly for coupling said speed bag for permitting said speed bag to pivot with respect to said platform when said speed the speed bag is struck by the user.

2. The speed bag support apparatus as set forth in claim 1, further comprising:

said actuating assembly comprising a pulley member, said pulley member being rotatably coupled to said stanchion member such that said pulley member is positioned in said interior space of said stanchion member, said pulley member engaging said cable member such that said pulley member rotates when said cable member is drawn across said pulley member to reduce contact between said stanchion member and said cable member.

3. The speed bag support apparatus as set forth in claim 1, further comprising:

said actuating assembly comprising a winding axle, said winding axle being rotatably coupled to said stanchion member in said interior space of said stanchion member of said wall mounting assembly, said winding axle being coupled to said cable member opposite said platform assembly, said cable member being wound onto said winding axle for rotating said platform assembly into the stored position when said winding axle is actuated by the user, said cable member being unwound from said winding axle for rotating said platform assembly to the deployed position from the stored position when said winding axle is actuated by the user.

4. The speed bag support apparatus as set forth in claim 3, further comprising:

said actuating assembly comprising a crank member, said crank member being operationally coupled to said winding axle, said crank member extending from said stanchion member of said wall mounting assembly such that said crank member is adapted for being rotated by a hand of the user for rotating said winding axle when the user wishes to rotate said platform assembly between the stored position and the deployed position.

5. The speed bag support apparatus as set forth in claim 4, further comprising:

said platform assembly comprising at least one support member, said support member being rotatably coupled to said wall mounting assembly, said support member being adapted for supporting the speed bag from said wall mounting assembly above the floor.

6. The speed bag support apparatus as set forth in claim 5, further comprising:

said wall mount assembly comprising an axle member, said axle member being coupled to a bottom end of said stanchion member; and said platform assembly comprising a sleeve member, said sleeve member being coupled to said support member, said sleeve member being slidably positioned over said axle member of said wall mount assembly such that said sleeve member is capable of rotating around said axle member for permitting rotation of said platform assembly with respect to said wall mount assembly.

7. The speed bag support apparatus as set forth in claim 5, further comprising:

said platform assembly comprising a platform member, said platform member being coupled to a bottom surface of said support member such that said platform member is positioned opposite said wall mount assembly when said platform assembly is positioned in the stored position, said platform member being adapted for being coupled to the speed bag such that said platform member is for rebounding the speed bag when the speed bag is struck by the user.

8. The speed bag support apparatus as set forth in claim 7, further comprising:

said platform assembly comprising a mounting assembly, said mounting assembly being coupled to said platform assembly opposite said support member, said mounting assembly being adapted for being coupled to the speed bag such that said mounting assembly is for permitting the speed bag to pivot with respect to said platform member when the speed bag is struck by the user.

9. The speed bag support apparatus as set forth in claim 8, further comprising:

said mounting assembly of said platform assembly comprising a base portion and a hook portion, said base portion being coupled to said platform member, said hook portion being pivotally coupled to said base portion, said hook portion being adapted for being coupled to the speed bag such that said hook portion of pivots with respect to said base portion when the speed bag is struck by a the user.

10. A speed bag support apparatus for supporting and storing a speed bag, the speed bag support apparatus comprising:

a wall mounting assembly comprising a plurality of stanchion members, each of said stanchion members being adapted for being coupled to a vertical support surface for supporting said wall mounting assembly from the vertical support surface;

a platform assembly being rotatably coupled to said wall mounting assembly, said platform assembly being rotatable between a deployed position defined by said platform assembly being positioned substantially perpendicular to said wall mounting assembly and a stored position defined by said platform assembly being positioned substantially parallel to said wall mounting assembly, said platform assembly being adapted for receiving the speed bag such that said platform assembly suspends the speed bag over a floor to be used by a user when said support assembly is in the deployed position;

an actuating assembly being coupled to each of said stanchion members of said wall mounting assembly, said actuating assembly being operationally coupled to said platform assembly such that said actuating system rotates said platform assembly between the deployed position and the stored position when said actuating assembly is actuated by the user;

said actuating assembly comprising a plurality of cable members, said cable members being coupled to said platform assembly, each of said cable members extending through an interior space of an associated one of said stanchion members such that said cable members pull said platform assembly into the stored position when said cable members are drawn into said interior space of the associated one of said stanchion members by the user;

said actuating assembly comprising a plurality of pulley members, each of said pulley members being rotatably coupled to the associated one of said stanchion members such that said pulley members are positioned in said interior space of the associated one of said stanchion members, each of said pulley members engaging one of said cable members such that each of said pulley members rotates when the associated one of said cable members is drawn across the associated one of said pulley members to reduce contact between the associated one of said stanchion members and the associated one of said cable members;

said actuating assembly comprising a winding axle, said winding axle being rotatably coupled to said stanchion members of said wall mounting assembly, said winding axle being coupled to each of said cable members opposite said platform assembly, said cable members being wound onto said winding axle for rotating said platform assembly into the stored position when said winding axle is actuated by the user, said cable members being unwound from said winding axle for rotating said platform assembly to the deployed position from the stored position when said winding axle is actuated by the user;

said actuating assembly comprising a crank member, said crank member being operationally coupled to said winding axle, said crank member extending from said wall mounting assembly such that said crank member is adapted for being rotated by a hand of the user for rotating said winding axle when the user wishes to rotate said platform assembly between the stored position and the deployed position;

said platform assembly comprising a plurality of support members, each of said support members being rotatably coupled to said wall mounting assembly, said support members being adapted for supporting the speed bag from said wall mounting assembly above the floor;

said wall mount assembly comprising an axle member, said axle member being coupled to a bottom end of each of said stanchion members;

said platform assembly comprising a sleeve member, said sleeve member being coupled to said support member, said sleeve member being slidably positioned over said axle member of said wall mount assembly such that said sleeve member is capable of rotating around said axle member for permitting rotation of said platform assembly with respect to said wall mount assembly;

said platform assembly comprising a platform member, said platform member being coupled to a bottom surface of each of said support members such that said platform member is positioned opposite said wall mount assembly when said platform assembly is positioned in the stored position, said platform member being adapted for being coupled to the speed bag such that said platform member is for rebounding the speed bag when the speed bag is struck by the user;

said platform assembly comprising a mounting assembly, said mounting assembly being coupled to said platform assembly opposite said support member, said mounting assembly being adapted for being coupled to the speed bag such that said mounting assembly is for permitting the speed bag to pivot with respect to said platform member when the speed bag is struck by the user; and said mounting assembly of said platform assembly comprising a base portion and a hook portion, said base portion being coupled to said platform member, said hook portion being pivotally coupled to said base portion, said hook portion being adapted for being coupled to the speed bag such that said hook portion of pivots with respect to said base portion when the speed bag is struck by a the user.

* * * * *